United States Patent [19]

Mueller et al.

[11] Patent Number: 4,746,235

[45] Date of Patent: May 24, 1988

[54] PRINTING ELEMENT HOMING DEVICE

[75] Inventors: Hans W. Mueller; Kenneth D. Vought, both of Cortland, N.Y.

[73] Assignee: Smith Corona Corporation, Cortland, N.Y.

[21] Appl. No.: 918,965

[22] Filed: Oct. 15, 1986

[51] Int. Cl.[4] ..... B41J 1/30

[52] U.S. Cl. ..... 400/144.2; 400/54

[58] Field of Search ..... 400/144, 144.1, 144.2, 400/144.3, 54, 320, 322, 279

[56] References Cited

U.S. PATENT DOCUMENTS

| | | | |
|---|---|---|---|
| 4,464,071 | 8/1984 | Sakakibara | 400/144.2 |
| 4,541,746 | 9/1985 | Bobart et al. | 400/144.2 |
| 4,605,324 | 8/1986 | Musso | 400/144.2 |

*Primary Examiner*—David Wiecking

[57] ABSTRACT

The present invention includes means for maintaining a printing element in its home position without any accompanying noise and for thereafter moving the carrier to its left margin position after the power switch is turned on. A latch member controlled by an actuator engages a notch in a flange of a rotating printing element drive gear for establishing the home position of the printing element. When the latch member engages the flange, the printing element drive gear motor is deenergized, stopping rotation of the drive gear, and the noise which would otherwise be caused by the print element drive motor continuously trying to rotate against the latch member is eliminated.

12 Claims, 3 Drawing Sheets

PRINTING ELEMENT HOMING DEVICE

CROSS-REFERENCES TO RELATED APPLICATIONS

The subject matter contained herein is related to copending U.S. patent application Ser. No. 918,964 "Typewriter Lid Actuated Printing Element Homing Device" filed Oct. 15, 1986.

Statement as to Rights to Inventions Made Under Federally Sponsored Research and Development The invention disclosed and claimed herein was not made under any federally sponsored research and development program.

BACKGROUND OF THE INVENTION (1) Field of the Invention

This invention is concerned with impact printing devices such as typewriters and, in particular, with such mechanisms in which the printing is achieved by a rotary device such as a daisy-type wheel or a cup-shaped printing element. Such elements typically include a plurality of spokes or petals each bearing a character or characters thereon.

A printing element of this type is commonly located on a carrier for movement along a print line direction during the printing operation. As the carrier is moved from print position to print position along the print line direction, the printing element is rotated about its axis for character selection purposes. When the printing element is in its proper position (i.e. when the character on the printing element to be printed is opposite the desired print position), the carrier is momentarily stopped and a print hammer on the carrier impresses the character on the printing element against an inking ribbon and a print receiving medium, such as paper.

After a printing operation occurs, the print hammer returns to its rest position and the printing element is rotated so that the next character on the printing element to be printed is opposite the desired print position. The next, and subsequent, printing steps occur in the same manner as described above, until a complete line has been printed. After printing a complete line, appropriate means are provided to move the carrier to the next starting line position for subsequent printing. A printing device which operates in this manner is the typewriter sold by SCM Corporation under the model "XE5000."

In printing devices of this type, it is essential that means be provided to assure that the printing element is engaged and maintained in its home position after the power switch to the printing device is turned on. Furthermore, it is highly desirable that the maintenance of the printing element in its home position be achieved without any accompanying noise. The purpose of the present invention is to provide such means.

(2) Description of the Prior Art

Examples of prior art patents which disclose printing element homing devices include U.S. Pat. No. 4,264,220 issued to S. A. Okcuoglu on Apr. 28, 1981 for a "Print Wheel Homing Apparatus"; U.S. Pat. No. 4,299,502 issued to K. J. S. Harre on Nov. 10, 1981 for an "Assembly for a Detachable Connection for a Printing Element in an Electric Office Machine"; and U.S. Pat. No. 4,428,694 issued to R. A. Ragen on Jan. 31, 1984 for a "Rotary Printing Device with Identifying Means and Method and Apparatus for in Situ Identification."

The Okeuoglu patent discloses a mechanism to assure that a rotary printing element is in its home position. Means are provided which first shift the print wheel carrier to an extreme position on the printer frame wherein a stop element is mounted. When the carrier is in its extreme position, the stop element extends into the path of another stop element attached and rotatable with the printing element. The printing element is then rotated until the stop element on the printing element engages the stop element on the printer frame. That position of engagement defines the home position of the printing elements.

The Harre patent discloses a means of removing a print element from an electric office machine that requires the printing element to be in its home position. To locate the print element in its home position, the print element is manually rotated until a dog member engages a recess in a lock washer connected to the print element.

The patent to Ragen discloses a means for identifying the "home" position of a printing device. That is accomplished by providing a protrusion on the print wheel which is rotatable therewith. An interposer abuts the rotatable protrusion and stops the print wheel drive motor to identify the home position. The information concerning the home position of the print wheel is then furnished to a microprocessor in the printing device.

SUMMARY OF THE INVENTION

The present invention includes a novel means for assuring that the printing element is in its home position after the power switch to the printing device is turned on and that the printing element is maintained in its home position without any accompanying noise. Means are provided for moving the carrier on which the printing element is mounted to the left side frame of the printer. A latch mounted on the carrier closes a switch for energizing a printing element motor in response to the carrier movement. An actuator, also mounted on the carrier, abuts a section of the left side frame and is caused to be rotated in response to further carrier movement. Rotation of the actuator in this manner permits the latch, previously prevented from moving by the actuator, to pivot towards the rotating printing element drive gear that is mounted on a common shaft with the printing element. When a finger on the latch engages a groove in the rotating drive gear, the printing element is in its home position, the shaft on which the printing element and drive gear is mounted ceases rotation and the switch is opened for deenergizing the printing element motor. The carrier is thereafter moved to the left margin rest position in proper orientation for printing to commence.

BRIEF DESCRIPTION OF THE DRAWING

A further understanding of the present invention may be had when the following detailed description is read in conjunction with the accompanying drawings, in which.

DETAILED DESCRIPTION OF THE PREFERRED EMBODIMENT

Figure 1:
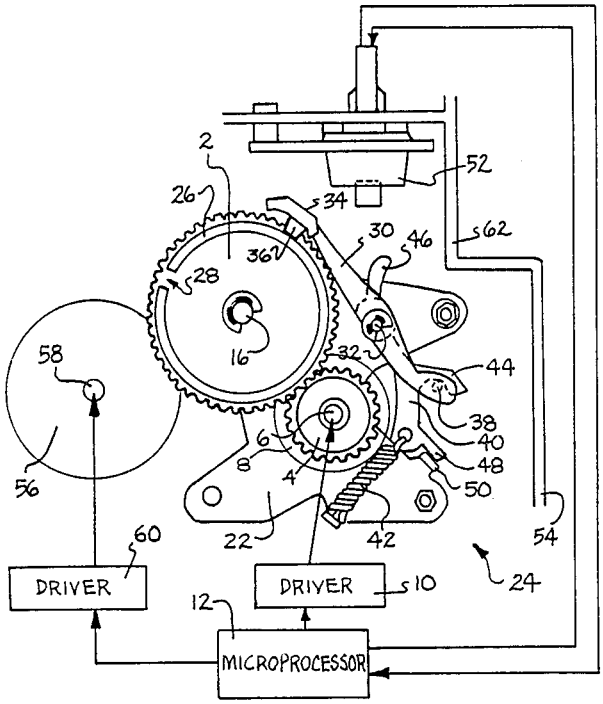
FIG. 1 is a rear elevational view of the printing element homing device of the present invention showing the device in its rest position.
Figure 4:
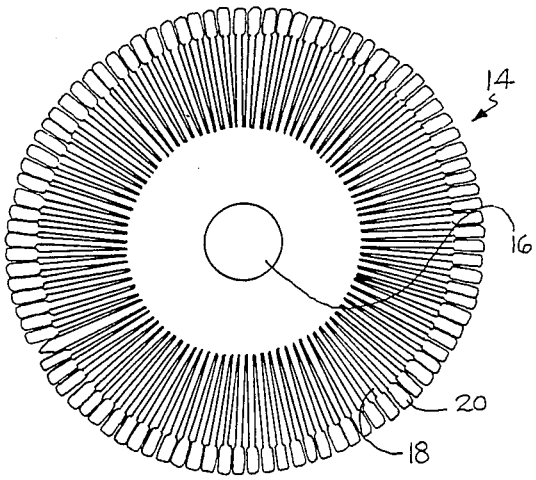
FIG. 4 is a front elevational view of a printing element of the type with which the present invention may be used.

There is shown in FIG. 1 a printing element drive gear 2 which is driven by a gear 4 on a shaft 6 of a printing element drive motor 8. The shaft 6 is caused to be rotated by a driver 10 under control of a microprocessor 12. The printing element drive gear 2 and a rotary printing element 14 (see FIG. 4) are mounted on a common drive shaft 16, whereby the printing element 14 and the drive gear 2 are rotated together. The rotary printing element 14 is of the daisy wheel printer type and includes a number of resilient pads 18 which support print characters 20 on their extremities.

The printing element drive gear 2, gear 4, and rotary printing element 14 are mounted on a frame 22 of a carrier (shown generally as 24) which moves along a print line direction during printing operations. As the carrier 24 is moved from print position to print position along the print line direction, the printing element 14 is rotated about its axis for character selection purposes. When the printing element 14 is in its proper position (i.e. when the character on the printing element 14 to be printed is opposite the desired print position), the carrier 24 is moementarily stopped as a print hammer (not shown) on the carrier 24 impresses the character on the printing element 14 against an inking ribbon and a print receiving medium such as paper (not shown).

The rear surface of the printing element drive gear 2 includes a flange 26 having a notch 28 therein. When the notch 28 is in a particular, and arbitrary, angular orientation with respect to the drive shaft 16, the printing element 14 is in its home position (i.e. a particular reference position known to the printing device).

Figure 2:
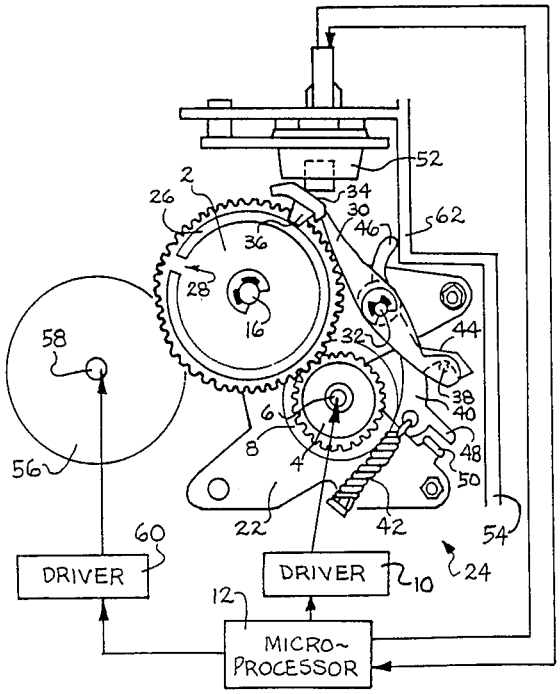
FIG. 2 is a rear elevational view of the printing element homing device of the present invention showing the device in an intermediate operative position.
Figure 3:
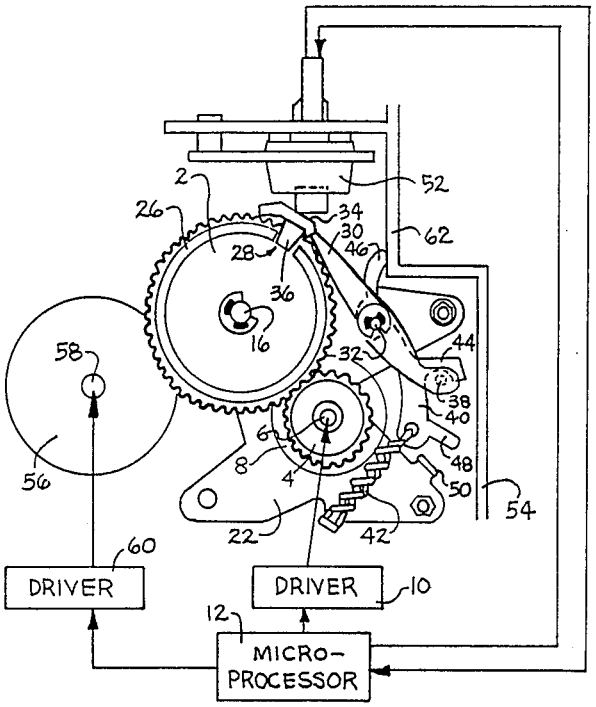
FIG. 3 is a rear elevational view of the printing element homing device of the present invention showing the printing element engaged in its home position.

It should be noted that throughout this specification, all references to direction of carrier travel and the direction of rotation of the various elements are from the perspective of a view at the front of the printing device rather than the rear as viewed in FIGS. 1–3. A latch member 30 is also mounted on the frame 22 and is free to rock about a pivot 32. The latch member 30 includes a cam surface 34 and a finger 36 which is adapted to enter the notch 28 of the flange 26 when the printing element 14 is in its home position. The latch member 30 also includes a pin 38 which extends toward the front of the printing device.

An actuator 40 mounted on the frame 22 is urged counterclockwise about the pivot 32 by a spring 42 which is also mounted on the frame 22. A first arm 44 on the actuator 40 has a first position in which it extends over the pin 38 of the latch member 30 to restrain the clockwise movement of the latch member 30 and has a second position in which it does not restrain the clockwise movement of the latch member 30. A second arm 46 on the actuator 40 is pivotable about the pivot 32. A third arm 48 on the actuator 40 abuts against a stop 50 on the frame 22 to limit the counterclockwise movement of the actuator 40.

A plunger switch 52 is mounted on a horizontal portion of a printing device frame 54 and is operative with the microprocessor 12 in a manner described more fully below. A carrier motor 56 having a rotor shaft 58 is mounted on the frame 22 in a known manner whereby rotation of the rotor shaft 58 in the clockwise and counterclockwise direction moves the carrier right and left, respectively, along carrier rails (not shown). A carrier motor arrangement of this type is used in various printing devices such as the aforementioned "XE 5000" typewriter sold by SCM Corporation.

The operation of the printing element homing device of the present invention will next be described.

When the ON-OFF switch of the printing device is switched to its ON position, a series of steps are performed to assure that the printing element 14 is properly seated with respect to the printing element drive shaft 16. These steps and the mechanism for achieving these steps are described in U.S. patent application Ser. No. 733,335, "Print Wheel Mounting," filed on 5/13/85, now abandoned and refiled as Ser. No. 935,656 on 11/26/86, both assigned to the present assignee.

After the printing element 14 is properly mounted in the printing device, the program in the microprocessor 12 activates a driver 60 to cause rotation of the rotor shaft 58 clockwise driving the carrier 24 to the left in the direction of an indented portion 62 of the printing device frame 54. As the carrier 24 moves to the left, the cam surface 34 of the latch member 30 closes the plunger switch 52 (see FIG. 2), which transmits a signal to the microprocessor 12. The position of the carrier 24 when the cam surface 34 is in position to close the plunger switch 52 is hereafter referred to as the first predetermined position. In response to that signal, the program in the microprocessor 12 activates the driver 60 causing limited rotation of the rotor shaft 58 clockwise, and incremental movement of the carrier 24 approximately 0.100 inch to the left.

As the carrier 24 is moved to the left, the second arm 46 of the actuator 40 abuts against the indented portion 62 of the printing frame 54, causing clockwise movement of the actuator 40 and the first arm 44 thereon. As the first arm 44 pivots clockwise about the pivot 32, the first arm 44 no longer prevents the latch member 30 from pivoting clockwise about the pivot 32.

Upon carrier 24 completing its incremental movement to the left, the program in the microprocessor 12 activates the driver 10 to cause counterclockwise rotation of the shaft 6 and the gear 4, which in turn causes clockwise rotation of the printing element drive gear 2 and the flange 26 thereon. The printing element 14 will be in its home position when the notch 28 of the flange 26 is opposite the finger 36 of the latch member 30 and, at that position, the finger 36 of latch member 30, being biased by an internal spring tension in the plunger switch 52, the notch 28 of the flange 26 to latch the printing element 14 in its home position.

As the finger 36 pivots clockwise and enters the notch 28 of the flange 26, the cam surface 34 of the latch member 30 pivots clockwise opening the switch 52. The position of the carrier 24 when the cam surface 34 is pivoted clockwise to open switch 52 is hereafter referred to as the second predetermined position. The opening of the switch 52 transmits a signal to the microprocessor 12 causing the program in microprocessor 12 to deactivate the driver 10 which deenergizes the printing element drive motor 8. The rotation of the printing element drive gear 2 is stopped when the finger 36 enters the notch 28 of the flange 26. The deenergizing of the printing element drive motor 8 and stopping rotation of the printing element drive gear 2 occur substantially simultaneously. In this manner, unlike prior art devices, the noise which would otherwise be caused by the print element drive motor 8 continuously trying to rotate against the finger 36 is eliminated. Also, the signal to the microprocessor 12 from the opening of the switch 52 enables the program in microprocessor 12 to cause rotation of the rotor shaft 58 counterclockwise. In that manner, carrier 24 is driven rightward to its preset left margin position. The printing element 14 is now in proper position for the printing operation to commence.

Figure 5:
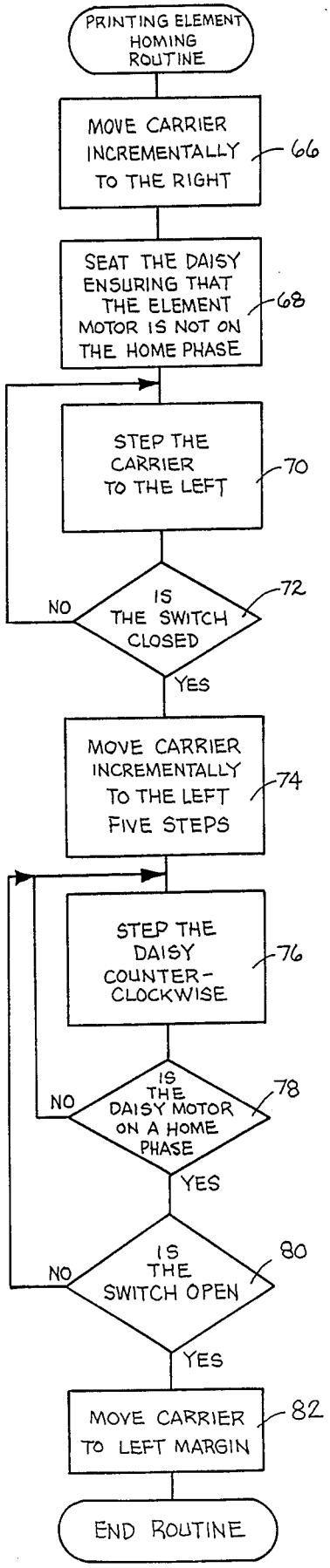
FIG. 5 is a flow chart of the printing element homing device according to the present invention.

In the flow chart of FIG. 5, the following conventional box shapes are used: boxes with semi-circular ends represent the start of a routine, a rectangular box represents a processing function or an operation, and a diamond box represents a decision for selecting one of two alternative outputs. As with most microprocessors, there is present a regular program idling loop in which rounds or sequential interrogatories of the various registers or flags are made and, depending on the status of these registers or flags, certain routines or operations are initiated. For clarity and ease of description, only a general description of the portions of routines relevant to the present printing element homing device features are depicted in the flow chart.

In accordance with the present invention, in the flow chart of FIG. 5 there is a routine entitled "Printing Element Homing Routine." The directions for moving the carrier 24 and for stepping the daisy 14 included in the flow chart of FIG. 5 are described as viewing the front of the typewriter. The fist operation box 66 denotes the incremental movement of the carrier 24 to the right and occurs immediately after the power switch is turned on. That assures that the carrier 24 is a sufficient distance from switch 52, so that the closure of switch 52 (and the engagement of the homing mechanism) will not prematurely occur. The next operation box 68 denotes the series of steps which are performed to assure that the printing element 14 is properly seated with respect to the printing element drive shaft 16. More specifically, after the printing element 14 is seated in accordance with the steps described in U.S. patent application Ser. No. 733,335, the printing element drive motor 8 is stopped two phases from its home phase to insure that the homing device does not engage during carrier initialization.

The flow proceeds to operation box 70 wherein the carrier 24 is stepped to the left in the direction of plunger switch 52 so that plunger switch 52 is eventually closed by cam surface 34 of latch member 30, thereby establishing the horizontal reference point from which subsequent carrier movement is measured.

The next box 72 is a decision to determine if plunger switch 52 has been closed by the cam surface 34 of the latch member 30. If the determination is NO, then the movement of carrier 24 to the left is continued. If the determination is YES, then an operation box 74 moves the carrier 24 incrementally to the left (in the described embodiment, the carrier 24 is moved five steps to the left, although the amount of incremental movement will vary from device to device).

In the next operation, denoted by an operation box 74, the printing element drive gear 2 is rotated counterclockwise. A decision box 78 determines whether the printing elemnt 14 is in its home position. If the decision is NO, then the printing element drive gear 2 is continue to be rotated counterclockwise until the decision in decision box 78 is YES.

When the decision in decision box 78 is YES, the flow goes to a decision box 80 which determines whether plunger switch 52 is open. If the plunger switch 52 is not opened, the program returns to operation box 76. If the plunger switch 52 is opened, rotation of the printing element drive motor 8 is discontinued. In operation box 82, the carrier 24 is moved to its left-hand margin position, and the routine is completed.

It is understood that the present disclosure of a printing element homing device has been made only by way of example, and that numerous changes in details of construction and the combination and arrangement of parts may be resorted to without departing from the true spirit and scope of the invention as hereinafter claimed.

What is claimed is:

1. In an impact printing device including a carrier moveable along a print line direction during a printing operation, a printing element having a home position and mounted on the carrier for movement therewith, means including a motor for rotating the printing element to its home position, and an improved printing element homing device comprising:

a. a switch for energizing the motor; and b. switch control means mounted on the carrier;

c. means for moving said carrier and switch control means mounted thereon to a first predetermined position;

d. said control means responsive to movement to the first predetermined position for closing the switch means for energizing the motor to move the printing element to its home position;

e. means for moving said carrier and switch control means thereon to a second predetermined position; and f. said control means responsive to said movement of the switch control means to the second predetermined position for latching the printing element in its home position and deenergizing the motor.

2. A printing element homing device for an impact printer according to claim 1, wherein the control means includes a drive member coupled to the printing element, a latch member for engaging the drive member to latch the printing element in its home position, and an actuator for permitting the latch member to latch the printing element in its home position when the carrier has moved to the second predetermined position.

3. A printing element homing device for an impact printer according to claim 2 wherein the drive member has a notch therein and the latch member has a finger biased into engagement with the notch when the printing element is in its home position to latch the printing element in its home position.

4. A printing element homing device for an impact printer according to claim 3 wherein the actuator includes a first arm which restrains the latch member from movement.

5. A printing element homing device for an impact printer according to claim 4 wherein the actuator includes a second arm which when moved causes the actuator to permit the latch member to latch the printing element in its home position.

6. A printing element homing device for an impact printer according to claim 5 wherein the actuator includes a third arm which abuts against a stop to limit the movement of the actuator.

7. A printing element homing device for an impact printer according to claim 2 further comprising an abutment for moving the actuator for permitting the latch member to latch the printing element in its home position in response to the carrier moving to the second predetermined position.

8. A printing element homing device for an impact printer according to claim 2 wherein the latch member closes the switch in response to movement of the carrier to the first predetermined position.

9. A printing element homing device for an impact printer according to claim 8 wherein the latch member opens the switch in response to movement of the carrier to the second predetermined position.

10. A printing element homing device for an impact printer according to claim 2 wherein the latch member and actuator are mounted on a common pivot.

11. A printing element homing device for an impact printer according to claim 2 wherein the drive member is mounted on a common shaft with the printing element for rotation therewith.

12. A printing element homing device for an impact printer according to claim 1 further comprises a microprocessor and a program stored in the microprocessor for moving the carrier to a predetermined left margin position after the printing element is in its home position and the motor is deenergized.

* * * * *